US008256149B2

(12) United States Patent
Nathamuni Balaji et al.

(10) Patent No.: US 8,256,149 B2
(45) Date of Patent: Sep. 4, 2012

(54) IRONING SHOE

(75) Inventors: Vignesh Nathamuni Balaji, Singapore (SG); Yong Jiang, Singapore (SG); Pieter Johannes Werkman, Drachten (NL); Maarten Van Den Boogaard, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 498 days.

(21) Appl. No.: 12/444,403

(22) PCT Filed: Oct. 2, 2007

(86) PCT No.: PCT/IB2007/053991

§ 371 (c)(1),
(2), (4) Date: Apr. 6, 2009

(87) PCT Pub. No.: WO2008/044165

PCT Pub. Date: Apr. 17, 2008

(65) Prior Publication Data

US 2010/0101122 A1 Apr. 29, 2010

(30) Foreign Application Priority Data

Oct. 9, 2006 (EP) ..... 06121943

(51) Int. Cl.
*D06F 75/38* (2006.01)
*D06F 75/40* (2006.01)

(52) U.S. Cl. ..... 38/97; 38/93

(58) Field of Classification Search ..... 38/74, 77.3, 38/77.6, 77.82, 77.83, 80, 81, 88, 93, 97
See application file for complete search history.

(56) References Cited

U.S. PATENT DOCUMENTS

| | | | | |
|---|---|---|---|---|
| 2,846,794 | A | 8/1958 | Pavlic | |
| 3,269,040 | A * | 8/1966 | Dikoff | 38/97 |
| 3,721,026 | A * | 3/1973 | McCallum | 38/75 |
| 3,906,187 | A * | 9/1975 | Turoczi, Jr. | 219/254 |
| 4,893,422 | A * | 1/1990 | Mahlich et al. | 38/77.3 |
| 7,661,212 | B2 * | 2/2010 | Hahn | 38/81 |
| 2002/0020085 | A1 | 2/2002 | Kobayashi et al. | |
| 2004/0172868 | A1 * | 9/2004 | Boulud et al. | 38/93 |

FOREIGN PATENT DOCUMENTS

| | | |
|---|---|---|
| BE | 904377 A | 6/1986 |
| JP | 09056997 A | 3/1997 |

* cited by examiner

*Primary Examiner* — Ismael Izaguirre

(57) ABSTRACT

The invention relates to an ironing shoe (10) comprising a garment contact surface (15) and having a means for accommodating a garment care agent such as an anti microbial agent, wherein accommodating the means is formed at least by the garment contact surface accommodating the garment care agent, which garment contact surface is capable of transferring the garment care agent to a piece of garment. By contacting the garment contact surface with the piece of garment, as is done during ironing, the agent is transferred to the garment. The invention further relates to a method of manufacturing an ironing shoe.

10 Claims, 2 Drawing Sheets

IRONING SHOE

FIELD OF THE INVENTION

The invention relates to an ironing shoe and a method of manufacturing an ironing shoe.

DESCRIPTION OF THE PRIOR ART

JP-09056997 discloses a steam iron comprising a main body and a base equipped with a heater and a steam jetting hole and a predetermined amount of water and an anti bacterial member provided in a water feed tank. By jetting steam containing the anti bacterial member from the lower surface of the iron base the anti bacterial member is applied to clothing.

The user has to fill and refill the water feed tank of such an iron with water and the anti microbial agent to ensure the availability of the anti microbial agent. This may be cumbersome and there is a risk of spilling water and/or the anti bacterial member.

SUMMARY OF THE INVENTION

It is an object of the invention to provide an easy way of applying a garment care agent to a piece of garment without having the requirement of refilling the iron with the garment care agent.

The object is achieved by an ironing shoe comprising a shoe sole, the shoe sole comprising a garment contact surface and having a means for accommodating a garment care agent, wherein the means is formed at least by the garment contact surface accommodating the garment care agent, which garment contact surface is capable of transferring the garment care agent to a piece of garment.

An ironing shoe as such is known in practice. Such a shoe, if mounted to a sole plate of an iron, is usually used to reduce the temperature of the surface in contact with the garment. The shoe comprises the shoe sole having a periphery, the periphery of the shoe sole corresponding to a sole periphery of the sole plate of an iron. The shoe sole comprises the garment contact surface. The garment contact surface, after mounting the shoe to the iron, is oriented away from the soleplate of the iron.

During ironing the garment contact surface of the ironing shoe according to the invention contacts the piece of garment and a quantity of the garment care agent is transferred to the garment.

Surprisingly, it has been found that the garment care agent is disposed on the garment by simply placing the ironing shoe according to the invention on the garment and moving it over the garment surface.

This way the garment agent is administered to a piece of garment without having to provide a reservoir containing a solution comprising the garment care agent.

The garment agent may be an anti microbial agent, an olfactory agent, an anti wrinkle agent or a combination thereof. A suitable antiwrinkle agent may be an organosilicone surfactant such as a Silwet® compound from Witco (US).

The anti microbial agent has anti microbial properties, this means that it kills or slows the growth of microbes like bacteria (antibacterial activity) and/or fungi (antifungal activity for instance against fungi known as mold) and/or viruses (antiviral activity) and/or parasites in particular on the ironed surface of the piece of garment.

After ironing using the ironing shoe according to the invention the ironed surface of the piece of garment is provided with a quantity of the anti microbial agent. The ironed surface thus obtained has anti microbial properties. By ironing a piece of garment using the ironing shoe according to the invention the resistance against bacteria, fungi and/or mold is enhanced.

The olfactory agent has scent properties, which means that it provides a scent, aroma or fragrance to the piece of garment ironed using the ironing shoe according to the invention. Usually a smell that is perceived as pleasant will be provided by the ironing shoe. Examples are without being limited thereto a flower smell or a smell of fresh linen.

The anti wrinkle agent facilitates removing wrinkles out of the piece of garment during ironing and may help to give a lasting ironing effect, e.g. decrease the ease of wrinkling of garment during use.

The anti microbial agent includes, but is not limited to anti microbial metal ions. Anti microbial metal ions are metal ions having anti microbial properties. Suitable examples are silver, copper, zinc, platinum or selenium ions or a combination thereof. The anti microbial properties of $Ag^+$ are known per se. These anti microbial metal ions are heat stable at the high temperatures of the sole plate of the iron; they are stable for at least 4 hours at a temperature of about 250 degrees Celsius.

Though ironing by itself involves the use of heat and can kill a certain percentage of the bacteria present on a piece of garment during the process of ironing, it does not enhance the resistance of garments towards e.g. bacteria or fungi. During use of the garment, bacteria start to grow. This is especially relevant for delicate fabrics such as silk because they normally should be washed and ironed at high temperatures. By ironing a piece of garment using the ironing shoe according to the invention, comprising the anti microbial agent as garment care agent, this anti microbial agent is deposited over the garment and the garment stays fresher for a longer period of time. In addition to making the garment more hygienic the ironing shoe sole itself, which comprises anti microbial agents, tends to be cleaner and reduces the growth of bacteria/fungi on the garment contact surface.

By depositing the anti microbial agent over the surface of garment the growth of bacteria is prevented or slowed down. Dust mites feed from bacteria present on for example a garment. Preventing or slowing down bacteria growth on a garment therefore also affects the dust mites on a garment: because their bacteria food source is reduced, they are also slowed down. Ironing using the ironing shoe according to the invention therefore has an anti dust mite effect on the ironed surface.

The amount of garment care agent transferred to the surface of the piece of garment depends, among other things on the number of strokes that the garment surface receives and the amount of garment care agent present at the garment contact surface of the ironing shoe. More strokes result in more transfer of the garment care agent. A higher concentration of garment care agent at the garment contact surface results in more transfer of garment care agent.

The transfer of the garment care agent requires surface contact between the garment contact surface comprising the garment care agent of the shoe sole and the piece of garment that is ironed. In case the garment care agent is present as particles or as part of a particle, the transfer is more effective when the surface area of these particles is relatively large. Small particles of e.g. silver, zinc, copper, selenium or platinum have a surface area that is relatively large when compared to larger particles. In an embodiment of the ironing shoe according to the invention the shoe sole comprises particles of silver, zinc, copper, selenium or platinum or a combination thereof having an average size in a range of 1 nm-500 nm, preferably 10-200 nm. A suitable choice is HyGate™ nano silver from Bio Gate AG (Germany), available as a product having an average silver particle size of 5-50 nm and as a product having an average silver particle size 50-200 nm.

A carrier may help to enhance the surface over which the garment care agent is present in the ironing shoe, thus facilitating the release of the agent.

The ironing shoe according to the invention may comprise a carrier comprising the anti microbial agent as the garment care agent. In a particular embodiment the carrier is a zeolite.

Zeolite is an inorganic, ceramic material that is open and porous in structure.

Good results were obtained using silver ions residing within a lattice of the zeolite. A suitable carrier comprising a suitable anti microbial agent is commercially available as AgION® (by AgION antimicrobial technologies Inc.). Alternatively, AgION® Silver Copper Zeolite may be used for instance AgION® antimicrobial compound is an inorganic antimicrobial system comprising an active ingredient—silver ions—and an inert mineral delivery material known as zeolite. AgION® combines antimicrobial properties of silver with Zeolite to form an ion exchange delivery system. The bonding of the silver to zeolite ensures continuous, controlled release of the metal over a long period. This results in a long lasting, on-demand, antimicrobial effect that destroys bacteria and suppresses future contamination. When moisture is present, ion exchange occurs.

The moisture may be present by ironing a wet or moist piece of garment. The piece of garment may be wet because it has been washed and has not fully dried, has been sprayed with water to moisten it or for instance by using steam from a steam iron comprising the ironing shoe according to the invention. The silver ions are released from the AgION® compound and have exchanged with ions in the environment.

Ironing using the ironing shoe according to the inventions results in applying silver ions on the garment.

The ironing shoe according to invention which is intended to be used in cooperation with a regular iron—without steam generating means—does not necessarily have to have a shoe sole opening.

The ironing shoe according to invention which is intended to be used in cooperation with a steam-ironing device comprises at least one shoe sole opening for letting through steam from the steam-ironing device.

In an embodiment of the ironing shoe according to the invention the ironing shoe comprises a shoe sole having at least one opening for letting through steam.

The sole plate of the iron is usually heated by an electric heating element. The temperature of the sole plate is kept at a desired temperature by means of a thermostat and a temperature dial. The number of dots on the temperature dial indicates the temperature of the sole plate surface of iron:

1 dot, average 110° C. this is the Low setting on most irons, 2 dots, average 150° C. this is the Medium setting on most irons, 3 dots, average 200° C. this is the High setting on most irons.

Delicate fabrics such as e.g. silk and velvet cannot be exposed to the 2-dot or 3-dot temperature setting because it would damage the fabric. Ironing delicate fabric is therefore usually done using the 1-dot low temperature setting of the iron. This may not give the desired ironing result. A user may therefore desire to use steam. The steam produced by the steam ironing system serves to dampen the fabric to be ironed. The application of moisture to a garment during ironing makes the ironing process easier, and reduces the time taken.

For steam ironing the 2-dot or 3-dot temperature setting is usually recommended, otherwise there is a risk of dripping or spitting of water. Because this 2-dot or 3-dot temperature setting is usually too high for ironing delicate fabric, an ironing shoe may be used. The ironing shoe may be used as a detachable accessory to the iron. If the user mounts the shoe to the sole plate of the iron, the ironing shoe acts as a thermal barrier that reduces the temperature of the surface in contact with the garment. This way the steam iron may be operated at a 2 or 3-dot temperature setting, while the temperature of the surface in contact with the garment is reduced. This way a piece of delicate garment may be ironed using steam without the risk of dripping or spitting of water due to a too low temperature of the iron.

In an embodiment of the ironing shoe according to the invention the shoe sole is made from a sole material comprising at least 0.05 weight percent of the garment care agent.

Alternatively, the shoe sole comprises 0.1-35 weight percent of the anti microbial agent based on the weight of the shoe sole.

Weight of the shoe sole is determined by weighing the body of the shoe sole. The borders of the body of the shoe sole are defined by the garment contact surface, an iron contact surface and the shortest distances between these two surfaces. The iron contact surface is the surface that is in contact with the sole plate of the iron if the shoe is mounted to the sole plate of the iron. The distance between the garment contact surface and the iron contact surface is the thickness of the shoe sole.

In an embodiment of the ironing shoe according to the invention the ironing shoe sole material is selected from a group comprising silicone rubber, polyether ether keton (PEEK), polyimide (PI), polyphenylene sulfide (PPS), polytetrafluorethylene (PTFE), polyamide-imide (PAI) or three-dimensional inorganic polymers such as methyl trimethoxy silane based materials. These are examples of heat-stable polymers that can be used while being exposed to a hot soleplate at the 3-dot setting of the iron.

The shoe sole may for instance be made from polyether ether keton comprising 8 wt % AgION®

The method according to the invention of manufacturing an ironing shoe comprises a shoe sole, the shoe sole comprising a garment contact surface accommodating a garment care agent, which garment contact surface is capable of transferring the garment care agent to a piece of garment, the method comprising the step of:

forming the shoe sole from a material comprising a garment care agent

In a practical embodiment of the method according to the invention the ironing shoe is injection molded using a moldable thermoplastic polymer comprising the garment care agent. An example may be molding the ironing shoe using PEEK comprising Ag+ ions, for instance in the form of AgION®. Alternatively, the ironing shoe is manufactured comprising a step of stamping the shoe sole from foil comprising the garment care agent.

In an embodiment of the ironing shoe according to the invention the means for accommodating the garment care agent comprises an agent layer comprising the garment care agent, the garment contact surface being a surface of the agent layer.

In such an embodiment at least part of the shoe sole of the ironing shoe is provided with the agent layer comprising the garment care agent, the agent layer comprising the garment contact surface. This way the amount of garment care agent per ironing shoe may be reduced.

Using the agent layer provides additional freedom in design of the ironing shoe according to the invention.

In a first practical example of the ironing shoe according to the invention the ironing shoe comprises a laminate having a laminate periphery corresponding to a sole periphery of the sole plate of an iron, the sole plate having a sole plate surface, the laminate comprising a heat insulating layer having an iron contact surface for making contact with the sole plate surface of the iron and a heat transfer layer having the garment contact surface for ironing.

In a second practical example of the ironing shoe according to the invention the ironing shoe comprises the laminate having the laminate periphery corresponding to the sole periphery of the sole plate of the iron the sole plate having the sole plate surface, the laminate comprising the heat transfer layer having the iron contact surface for making contact with the sole plate surface of the iron and the heat insulating layer having the garment contact surface for ironing. In the second example the heat transfer layer and heat insulating layer are situated in reverse order as compared to the first example.

Typically, the heat insulating layer comprises thermoplastic polymers selected from a group comprising silicone rubber, polyether ether keton (PEEK), polyimide (PI), polyphenylene sulfide (PPS), polytetrafluorethylene (PTFE), polyamide-imide (PAI) or three-dimensional inorganic polymers such as methyl trimethoxy silane based materials. These polymers have suitable heat stable (suitable for use at the 3-dot setting) and heat insulating properties.

The heat transfer layer typically comprises a metal layer. The metal layer may for instance be made of aluminum, aluminum alloy or stainless steel. In case the metal layer is the agent layer it comprises the garment care agent. This may be in the form of particles such as silver particles comprising silver ions on their outer surface in the presence of air.

Depending on the configuration either the heat insulating layer or the heat transfer layer is the agent layer, comprising the garment care agent and the garment contact surface.

The shoe sole may comprise an additional layer provided such that it comprises the garment contact surface. In practice this means the additional layer is present on the outside of the ironing shoe. In such a situation the additional layer is the agent layer.

This additional layer may for instance comprise a sol gel coating or an enamel coating comprising the garment care agent provided on the metal layer, such as aluminum or stainless steel. The metal layer being the interposed between the additional layer and the heat insulating layer. The heat transfer layer in this example comprises the metal layer and the additional layer.

Alternatively, the additional layer is a layer of silver, copper, copper-alloy or zinc. When this layer is exposed to oxygen, as is present in the air, conversion of metal to metal oxide occurs spontaneously at the surface of these particles, resulting in the presence of anti microbial metal ions (in this case silver, copper or zinc) at the garment contact surface.

A thickness in a range of 0.5-250 microns has been found suitable for the agent layer.

The temperature of the garment contact surface of the ironing shoe is reduced as compared to the soleplate of the iron. As a result of this reduced temperature the temperature stability that is needed for the garment care agent present in the agent layer is reduced. As a result a broader range of garment care agents may be successfully applied in the agent layer. For instance organic anti microbial agents such as chlorohexidine or 1,3-dihalo-5,5 dimethylhydantoin, oxazolidinores or imidazolidinones may be used. Alternatively, Triclosan (CAS Nr: 3380-34-5) may be used.

This is especially the case in the first practical example of the ironing shoe. In this example the layer which during use is in contact with the hot ironing sole plate is the insulating layer. The temperature of the agent layer having the garment contact surface is reduced.

In an embodiment of the ironing shoe according to the invention the agent layer comprises at least 0.05 weight percent of the garment care agent.

The garment care agent is transferred more readily when the surface on which the garment care agent is present is larger. A carrier may help to enhance the surface over which the garment care agent is spread, thus facilitating the release of the garment care agent. In an alternative of the ironing shoe according to the invention the agent layer comprises a carrier comprising the garment care agent, in particular the anti microbial agent. In a particular embodiment the carrier is a zeolite comprising ions of silver, copper or zinc or a combination thereof.

In an embodiment the agent layer made of thermoplastic polymer, sol gel or enamel material layer comprises 0.1-35 weight percent of the garment care agent.

The method according to the invention for manufacturing an ironing shoe having a shoe sole, comprising an agent layer, the agent layer comprising a garment care agent and having a garment contact surface, which garment contact surface is capable of transferring the garment care agent to a piece of garment, the method comprising the step of providing the agent layer.

A suitable way to provide the agent layer is by sputtering the metal on the shoe sole of the ironing shoe, this way typically a layer having a thickness of 0.5-3 microns can be obtained.

Alternatively, the metal layer is walsed onto the shoe sole of the ironing shoe. This way a soleplate having a metal layer having a thickness in a range of 150-250 microns can be obtained.

Another way to execute the method according to the invention as defined in claim 8 is to apply a polymer layer comprising the garment care agent, such as the anti microbial agent. Suitable thermoplastic polymers are thermally stable polymers such as silicones, polyimides, polyamide imide, polyether amide, polyether sulfone, polyether ether keton, polyphenyl sulfide polysulfone and polytetra fluoro ethylene.

Another way to execute this method according to the invention is to apply a sol gel coating comprising the garment care agent.

Applying a sol-gel coating as such is known per se, for manufacturing a soleplate it typically comprises steps such as:

1) providing a sol-gel solution,
2) spraying this sol-gel solution onto the ironing plate,
3) drying the sol gel layer thus obtained, i.e. by heating the ironing plate, this way solvent is evaporated leaving behind a gel network,
4) curing the gel by heating.

The steps 3 and 4: i.e. drying and subsequent curing, are usually combined in one curing step.

A way to execute the method according to the invention is to mix the garment care agent with the sol-gel solution in step 1 mentioned above.

In another way to execute the method according to the invention a known sol-gel solution is applied to the shoe sole, on top of this known sol-gel solution a garment care agent, such as an anti microbial agent, is applied e.g. by spraying a solution that comprises the garment care agent. The shoe sole thus obtained is cured. In this embodiment the garment care agent is sprayed after step 2 (see above) onto the wet sol-gel layer and penetrates at least partly into the wet sol gel layer, the two part-layer thus obtained is then cured (steps 3 and 4). The garment care agent in this embodiment is present in a very thin layer, located on the outside of the ironing shoe i.e. the thin layer comprises the garment care surface. This very thin layer may have a thickness in a range of 0.5-1.5 microns.

The invention further relates to a garment care system comprising an iron having a soleplate and an ironing shoe according to the invention, the soleplate and the ironing shoe being arranged for mutual cooperation. The ironing shoe according to the invention may for example be provided with fastening means, such as a raised flank portion and a protrusion, to be able to mount the shoe to the soleplate of the iron known per se and to prevent the shoe from disengaging from the sole plate during use. The garment care system has the same benefits of the ironing shoe as described above.

The invention also includes any possible combination of features or subject matter as claimed in any one of the claims.

BRIEF DESCRIPTION OF THE DRAWINGS

The invention will now be described by way of example with reference to the accompanying drawings. In principle aspects can be combined.

DETAILED DESCRIPTION OF DRAWINGS

Figure 1:
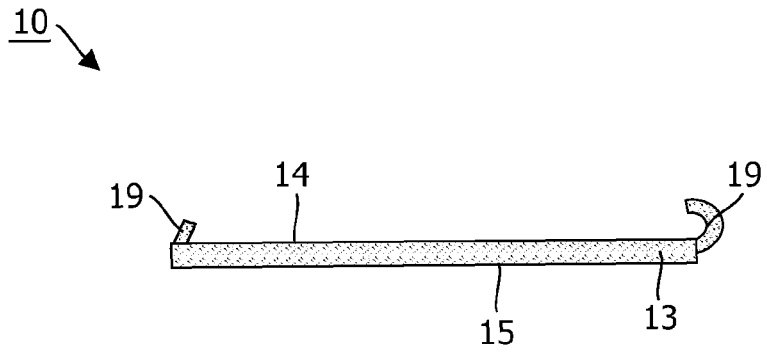
FIG. 1 schematically depicts a first embodiment of the ironing shoe according to the invention.

In FIG. 1 the first embodiment of the ironing shoe according to the invention is schematically depicted. The ironing shoe 10 comprises a shoe sole 13 having a garment contact surface 15 and an iron contact surface 14. The shoe sole comprises a garment agent. By contacting the garment contact surface 15 with a piece of garment, as is done during ironing, the garment care agent, such as an anti microbial agent, is transferred to the piece of garment.

The shoe 10 is provided with a fastener 19 known per se.

Figure 2:
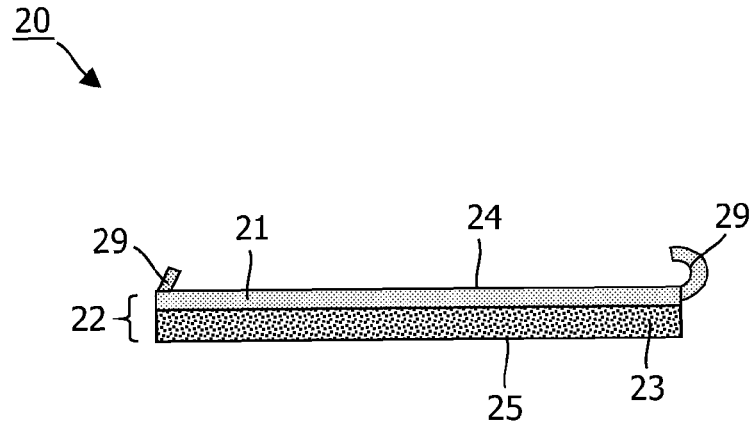
FIG. 2 schematically depicts a second embodiment of the ironing shoe according to the invention.

In FIG. 2 the second embodiment of the ironing shoe according to the invention is depicted schematically. The ironing shoe 20 comprises a shoe sole 22 provided with an agent layer 23 comprising a garment care agent. The agent layer has a garment contact surface 25. The agent layer 23 is provided on an inner sheet 21 having an iron contact surface 24. The shoe 20 is provided with a fastener 29 known per se.

Figure 3:
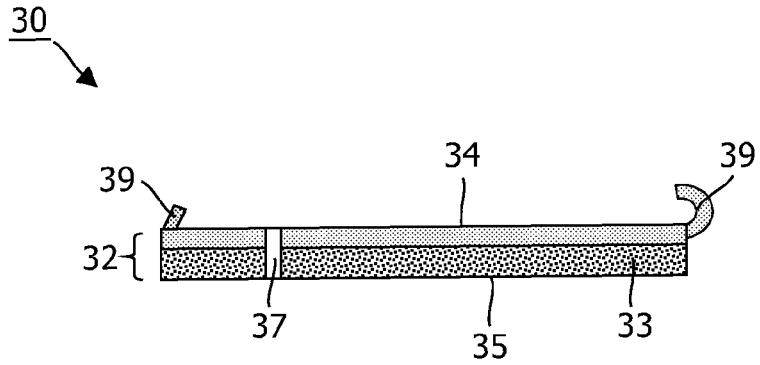
FIG. 3 schematically depicts a third embodiment of the ironing shoe according to the invention.

In FIG. 3 the third embodiment of the ironing shoe according to the invention is depicted schematically. The ironing shoe 30 comprises a shoe sole 32 having at least one shoe sole opening 37. The shoe sole comprises a agent layer 33 comprising a garment care agent and having a garment contact surface 35 for ironing.

Figure 4:
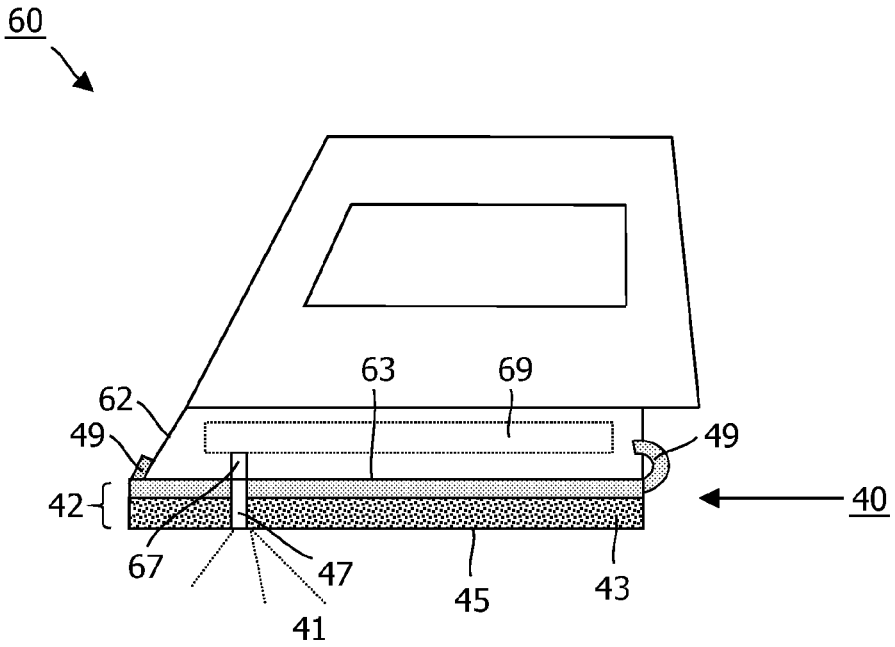
FIG. 4 schematically depicts the third embodiment of the ironing shoe according to the invention mounted on a steam iron.

In FIG. 4 the third embodiment of the ironing shoe according to the invention mounted on a steam iron is schematically depicted.

The ironing shoe 40 according to the invention is depicted mounted on a known steam iron 60 via a fastener 49 known per se. The known steam iron 60 comprises a soleplate 62 having a soleplate surface 63 and steam generating means comprising a steam chamber 69 (schematically shown) and a water reservoir (not shown). An opening 67 is present in the soleplate 62 for letting through steam generated by the steam generating means.

The shoe sole 42 has a periphery similar to a sole periphery of the sole plate 62 of the iron. The ironing shoe 40 comprises a shoe sole 42 having at least one shoe sole opening 47 for letting through steam 41. The shoe sole comprises an agent layer 43 comprising a garment care agent and having a garment contact surface 45 for ironing.

Figure 5:
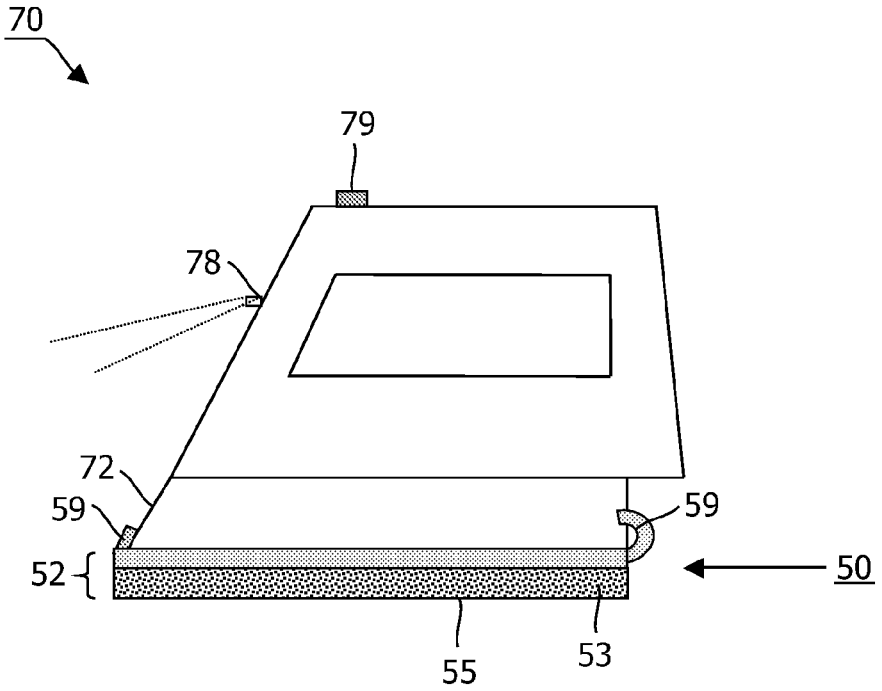
FIG. 5 schematically depicts the second embodiment of the ironing shoe according to the invention mounted on an iron.

In FIG. 5 the second embodiment of the ironing shoe according to the invention mounted on an iron is schematically depicted.

The ironing shoe 50 according to the invention is depicted in a position mounted on a soleplate 72 of a known iron 70 via a fastener 59 known per se. The shoe sole 52 has a periphery similar to a sole periphery of the sole plate 72 of the iron 70. The shoe sole 52 comprises an agent layer 53 comprising a garment care agent and having a garment contact surface 55 for ironing.

In case the garment care agent is transferred more effectively in the presence of water, the user may activate a water trigger 79 to spray water from a sprayer 78 to the piece of garment to moisten the garment.

For transfer of ions such as silver, copper, zinc, platinum, selenium ions or a combination thereof moist is needed. The experiments showed that even without adding additional water, silver ions were transferred from the garment contact surface to the surface of the piece of garment.

EXPERIMENTS

To illustrate the effect of selecting a certain anti microbial agent, the following examples are given hereinafter:

Reference

An ironing shoe comprising a sol gel coating without the presence of any antibacterial agent, basically referenced ironing shoe. Referred to as S1

Example 1

The manufacturing steps of the reference ironing shoe were followed whereby, after application of the sol gel top coating, a 2.5 wt % AgION® ethanol solution was sprayed onto the wet top coating (2.5 wt % AgION® comprises 0.06 wt % Ag+). Subsequently the shoe was dried and cured. In this example the anti microbial agent is sprayed onto the wet sol-gel top coat layer and penetrates at least partly into this wet sol gel layer, the thus obtained two-part layer is cured. It was estimated that the anti microbial agent in this example had penetrated about 1 micron deep into the sol-gel topcoat of about 10 microns. This way ironing shoe S2 was obtained.

Example 2

The steps of manufacturing the reference ironing shoe were followed whereby in the mixture of the sol-gel top coating, an AgION® ethanol solution (ratio of 30:70 by weight) is mixed in. This way an antibacterial sol-gel mixture is obtained comprising about 8% AgION®.

Because the sol gel mixture is alcohol based, an alcohol compatible AgION® powder was used.

A skilled person may select a different weight ratio if preferred.

Subsequently, the shoe was dried and cured. This way ironing shoe S3 was obtained, which ironing shoe had an anti microbial top coat layer about 10 microns thick.

Example 3

A water based AgION® slurry is mixed with a Teflon™ (by Du Pont) based Ceralon coating (by Whitford).

This 2.5 solids wt % AgION® mixture is applied onto the ironing shoe by spraying. The Ceralon coating is a water based coating and for obtaining a mixture, a water based AgION® (slurry) was used. The layer thus obtained was dried and cured. This way ironing shoe S4 was obtained.

Ironing Tests

Tests with ironing shoe S1-S4 were done using the same Azur irons from Philips.

The irons used were steam irons, but the steaming function was tuned off in some experiments, however.

All samples described were tested in one run.

Pieces of standard cloth (each cut from the same moiré fabric 0.4 g/m) were cut, (ca. 13.5×ca. 66.5 cm) and handled as follows 1) Washing;
2) Ironing using one of the sole plates 1-4 as prepared as described above;
3) After 3 days the pieces of cloth were inoculated with Staphylococcus Aureus bacteria. This was carried out by applying the inoculum to the cloth (According to ATCC 6538);
4) After 18 hrs the incubation was stopped, after which the antimicrobial performance was determined.

The inoculum is a nutrient medium (agar) comprising the bacteria in a specified concentration according to Japanese Industrial Standard (JIS) 'Testing for antibacterial activity and efficacy on textile products' [reference number: JIS L 1902:2002 (E) page: 11; 8.1.2 preparation of test inoculum, b) Inoculum for quantitative test (absorption method)].

The inoculum prepared is put on the test piece at several points. And the test piece itself is in a vial (For further details see JIS L 1902:2002 page: 20; 10.1.3 Test operation & 10.1.2 Sterilization of test piece).

The following was determined:

Ma: Average of common log of number of living bacteria of 3 test pieces immediately after inoculation of inoculum on standard cloth;

Mb: Average of common log of number of living bacteria of 3 test pieces after 18-hour incubation on standard cloth;

Mc: Average of common log of number of living bacteria of 3 test pieces after 18-hour incubation on antibacterial treated sample.

From these experimental data the growth value (F), the bacteriostatic activity value (S) and the bactericidal activity value (L) were derived.

These are defined as follows:

$$F(\text{growth value})=Mb-Ma$$

The growth value is derived to determine whether the test was effective

If F>1.5, then the test is considered to be effective and the bacteriostatic and bactericidal activity value were calculated.

If F<=1.5, then the test is to be repeated.

The activity tests showed that the bacteria sample used was active.

$$S(\text{bacteriostatic activity value})=Mb-Mc$$

Inoculation bacteria, on the textile product treated with antibacterial finish, and on the standard cloth, then count the number of living bacteria after culture, and the numerical difference of living bacteria between treated product and standard cloth shows the bacteriostatic activity value.

$$L(\text{bactericidal activity value})=Ma-Mc$$

Inoculation of bacteria on the textile product treated with bacteria-control finish, and on the standard cloth, then count the number of living bacteria after culture, and the numerical difference between the number of inoculated bacteria and that of the living bacteria on a treated product shows the bactericidal activity value.

The Bacterium Kill was determined as follows:

{(Number of bacteria in the standard cloth at 0 hr−Number of bacteria in the antibacterial treated cloth after 18 hr)/Number of bacteria in the standard cloth at 0 hr}×100%.

The results are evaluated as follows:

A Bacteriostatic Activity Value≧2.0 indicates the product can inhibit the growth of bacteria.

A Bactericidal Activity Value≧0 indicates that the product can suppress the growth of bacteria.

In the test using reference ironing shoe 1 the steam function was switched off, practically it was used as a dry iron. A Bacteriostatic value of 0, a Bactericidal value of <−1 and no bacterium kill was determined after 18 hrs of incubation.

Tests were performed using ironing shoe S2-S4 under steaming and dry conditions and using the same amount of strokes as for the reference.

In comparative tests ironing shoe S2 gave better anti microbial results than ironing shoe S3.

For ironing shoe S2 both steam and dry tests resulted in a Bacteriostatic value of >2 and a Bactericidal value of >0. For ironing shoe S2 both steam and dry tests resulted in a Bacterium Kill of >90%.

Some Bacteriostatic activity was observed for ironing shoe S4, the garment was evaluated as being refreshed.

A piece of cloth ironed using ironing shoe S2 was determined to comprise ca. 0.004 microgram Ag/cm2 on its ironed surface.

Summarising, the invention relates to an iron comprising an ironing shoe having a garment contact surface and having a means for accommodating an anti-microbial agent, wherein the means is formed at least by the garment contact surface accommodating the anti microbial agent, which garment contact surface is capable of transferring the anti microbial agent to a piece of garment. In a practical embodiment said means has a layer comprising the anti microbial agent, the layer having the garment contact surface.

The invention claimed is:

1. An ironing shoe comprising a shoe sole wherein the shoe sole comprises a garment contact surface and a means for accommodating a garment care agent, wherein the accommodating means is formed at least by the garment contact surface accommodating the garment care agent, which garment contact surface is capable of transferring the garment care agent to a piece of garment in response to (i) placing the ironing shoe on a garment to establish a required surface contact between the garment contact surface of the shoe sole and a surface of the garment and (ii) moving the ironing shoe over the garment surface, wherein a quantity of garment care agent is transferred from the shoe sole to the garment via movement of the garment contact surface in contact with and over the garment surface.

2. The ironing shoe according to claim 1, wherein the shoe sole further comprises at least one opening for letting through steam.

3. The ironing shoe according to claim 1, wherein the shoe sole further comprises a sole material of at least 0.05 weight percent of the garment care agent.

4. The ironing shoe according to claim 3, wherein the sole material is selected from a group consisting of silicone rubber, polyether ether keton, polyimide, polyphenylene sulfide, and polyamide-imide (PAI).

5. The ironing shoe according to claim 1, wherein the means for accommodating the garment care agent comprises an agent layer that comprises the garment care agent, the garment contact surface being a surface of the agent layer.

6. The ironing shoe according to claim 5, wherein the agent layer further comprises at least 0.5 weight percent of the garment care agent.

7. The ironing shoe according to claim 1, wherein the garment care agent is selected from a group consisting of ions of silver, zinc, copper, selenium, platinum, triclosan, and a combination thereof.

8. Method of manufacturing an ironing shoe having a shoe sole, wherein the shoe sole comprises an agent layer, the agent layer comprising a garment care agent and having a garment contact surface, which garment contact surface is capable of transferring the garment care agent to a piece of garment in response to (i) placing the ironing shoe on a garment to establish a required surface contact between the garment contact surface of the shoe sole and a surface of the garment and (ii) moving the ironing shoe over the garment surface, wherein a quantity of garment care agent is transferred from the shoe sole to the garment via movement of the garment contact surface in contact with and over the garment surface, the method comprising the step of providing the agent layer that comprises the garment care agent to the shoe sole.

9. Method of manufacturing an ironing shoe comprising a shoe sole, wherein the shoe sole comprises a garment contact surface accommodating a garment care agent, which garment contact surface is capable of transferring the garment care agent to a piece of garment in response to (i) placing the ironing shoe on a garment to establish a required surface contact between the garment contact surface of the shoe sole and a surface of the garment and (ii) moving the ironing shoe over the garment surface, wherein a quantity of garment care agent is transferred from the shoe sole to the garment via movement of the garment contact surface in contact with and over the garment surface, the method comprising the step of:

forming the shoe sole from a material that comprises a garment care agent.

10. A garment care system comprising an iron having a soleplate and an ironing shoe according to claim 1, the soleplate and the ironing shoe being arranged for mutual cooperation.

* * * * *